US007690050B2

(12) United States Patent
Stockhamer

(10) Patent No.: US 7,690,050 B2
(45) Date of Patent: Apr. 6, 2010

(54) METHOD AND APPARATUS FOR PREVENTING THE SPREAD OF GERMS WHILE COUGHING OR SNEEZING

(76) Inventor: Lee Stockhamer, 1788 Horton Rd., Mohegan Lake, NY (US) 10547

( * ) Notice: Subject to any disclaimer, the term of this patent is extended or adjusted under 35 U.S.C. 154(b) by 0 days.

(21) Appl. No.: 11/538,641

(22) Filed: Oct. 4, 2006

(65) Prior Publication Data

US 2007/0118943 A1 May 31, 2007

Related U.S. Application Data

(60) Provisional application No. 60/732,353, filed on Nov. 1, 2005.

(51) Int. Cl.
*A41D 27/00* (2006.01)

(52) U.S. Cl. ..... 2/69; 2/160; 2/170; 2/16; 2/171; 221/85

(58) Field of Classification Search ..... 2/69, 2/160, 170, 16, 910, 171, 161.6; 221/185
See application file for complete search history.

(56) References Cited

U.S. PATENT DOCUMENTS 4,244,057 A 1/1981 Burnham
4,401,233 A 8/1983 Frey
4,536,889 A 8/1985 Taylor
5,678,728 A 10/1997 Leto
5,901,379 A * 5/1999 Hirata ..... 2/170
6,074,525 A * 6/2000 Richards ..... 162/100
D446,381 S 8/2001 Garfield
2002/0084279 A1 7/2002 Lickstein
2004/0161450 A1* 8/2004 Buder ..... 424/443
2005/0129897 A1* 6/2005 Zhou et al. ..... 428/43

* cited by examiner

*Primary Examiner*—Gary L Welch
*Assistant Examiner*—Alissa J Tomkins
(74) *Attorney, Agent, or Firm*—Hoffmann & Baron, LLP

(57) ABSTRACT

An apparatus to reduce the effect of coughing or sneezing is disclosed. The apparatus includes a pad having a configuration that conforms to a general outline of a person's nose and mouth region. The pad includes a bottom having a first side and an opposing second side, an absorbent material disposed on the first side of the bottom to receive byproducts of a cough or a sneeze, and a peripheral wall extending from the bottom substantially upward and around the periphery of the bottom. The peripheral wall is configured to prevent escape of the byproducts from the pad.

22 Claims, 5 Drawing Sheets

Fig. 5
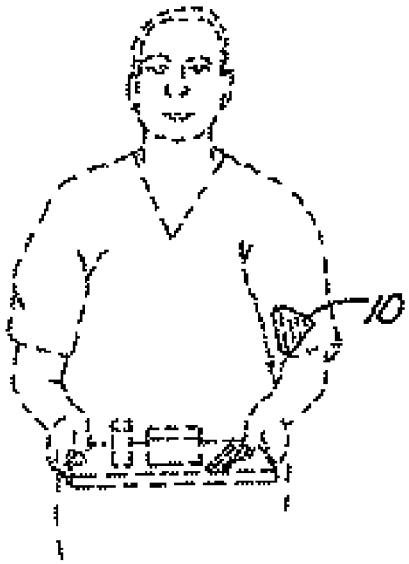
Fig. 6
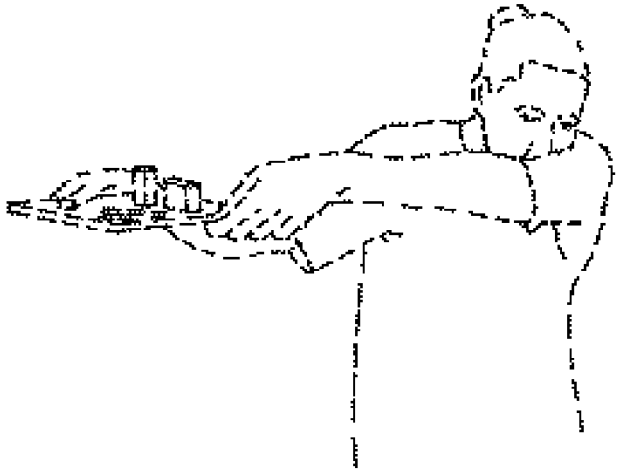
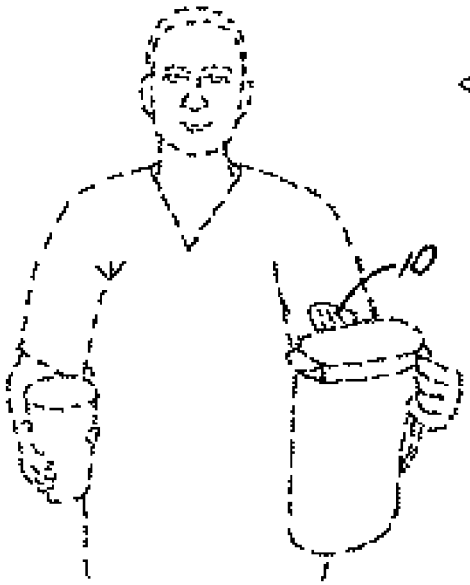
Fig. 7
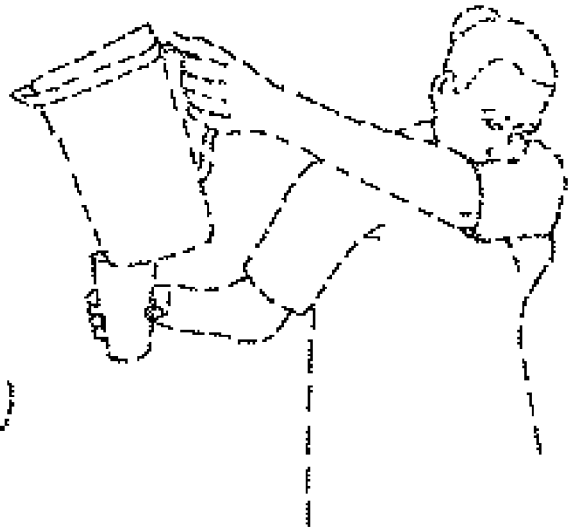
Fig. 8

METHOD AND APPARATUS FOR PREVENTING THE SPREAD OF GERMS WHILE COUGHING OR SNEEZING

CROSS REFERENCE TO RELATED APPLICATIONS

This application claims priority from U.S. Provisional Patent Application Ser. No. 60/732,353 filed Nov. 1, 2005 and incorporated by reference herein in its entirety.

BACKGROUND OF THE INVENTION

1. Field of the Invention

The present invention relates to reducing the effects of coughing and sneezing, and more particularly to an absorbent pad which can be used on an arm while both hands are occupied.

2. Description of Related Art

In the health care and food preparation fields, as well as in everyday life, the prevention of the spread of germs through what the Centers for Disease Control and the U.S. Dept. of Health and Human Services calls the practice of "respiratory etiquette" (i.e. covering ones' mouth when coughing and sneezing) has become a priority. Facemasks, while effective at blocking many of these germs, are not worn in many situations. The problem is that often a cough or sneeze occurs with little warning and the individual does not have the time to reach into his or her pocket for a tissue or is carrying an object and is unable to obtain or use a conventional tissue.

A sneeze can travel up to 100 MPH, and stifling or attempting to stop a sneeze can cause serious injuries, including broken facial bones. There exist various devices designed primarily to be worn on ones' arm, wrist or glove during winter outdoor activities for wiping a dripping nose, but these are not suitable for the purpose of stopping the spread of germs caused by the forceful expulsion of germ-laden air created by coughs and sneezes.

U.S. Pat. No. D446,381 discloses a handkerchief attachable to a user's wrist. The shape is not conformed to a human nose and mouth, nor are a welt and baffle disclosed. A protective sheet is also not disclosed.

U.S. Pat. No. 4,244,057 discloses a nasal drip absorbing device wearable on a cuff or back of a glove. The shape is not conformed to a human nose and mouth, nor are a welt and baffle disclosed. A protective sheet is also not disclosed.

U.S. Pat. No. 4,401,233 discloses a dispenser for tissues. The dispenser is not made to be coughed or sneezed into. The shape is not conformed to a human nose and mouth, nor are a welt and baffle disclosed.

U.S. Pat. No. 4,536,889 discloses a wearable absorbent pad for wiping a wearer's nose. A protective sheet (31) is disclosed. The shape is not conformed to a human nose and mouth, nor are a welt and baffle disclosed.

U.S. Pat. No. 5,678,728 discloses a dispenser for flexible sheets. The dispenser is not made to be coughed or sneezed into. The shape is not conformed to a human nose and mouth, nor are a welt and baffle disclosed.

U.S. Publication No. 20020084279 discloses a dispenser for tissues. The dispenser is not made to be coughed or sneezed into. The shape is not conformed to a human nose and mouth, nor are a welt and baffle disclosed. A protective sheet is also not disclosed.

Accordingly there is a need for a simple wearable device, which can hold a single or multiple disposable absorbent pads to reduce the amount of germs expelled into the air when it is coughed or sneezed into and which can optionally contain a pocket or pockets which can store latex gloves, a facemask, and antibacterial wipes, for preventing the spread of disease.

SUMMARY OF THE INVENTION

Disclosed is a device that includes one or more cough/sneeze absorbent pads attached to a washable, reusable armband or alternately, a completely disposable device that includes one or more disposable absorbent pads. A pad can be peeled off and used while held in the hand but preferably, when worn on one's arm, can be coughed/sneezed into while the device is on the arm. This allows the device to be utilized even when one's hands are not available, such as for anyone working in a health care setting, a chef preparing food or a waiter carrying plates of food. This prevents the common occurrence of sneezing/coughing out into the air or into one's hands or sleeve, which are unsanitary practices. The pad is shaped to receive a user's nose and mouth, and a raised welt and/or a baffle around the perimeter (peripheral wall) greatly reduces the amount of germs that escape, as does the shape which conforms generally to the position of the user's nose and mouth. Optionally, a pocket or pockets contained within the armband can hold gloves, facemask(s) and antibacterial wipes.

BRIEF DESCRIPTION OF THE DRAWINGS

The present invention will be more fully understood from the detailed description below when viewed in conjunction with the accompanying drawings in which:

FIG. 5 shows a nurse in a hospital carrying a tray of food while using the device of FIG. 1;

FIG. 6 shows the nurse of FIG. 5 coughing or sneezing into a pad of the device of FIG. 1 while holding the tray of food;

FIG. 7 shows a nurse in a hospital carrying a glass and a pitcher of liquid while using the device of FIG. 1;

FIG. 8 shows the nurse of FIG. 7 coughing or sneezing into a pad of the device of FIG. 1 while holding the glass and pitcher;

FIG. 15 shows an alternate embodiment with the device with multiple pads being attached to an elastic band that can be placed on a person's arm and showing the device in a rectangular shape to illustrate that the pads can be made in a variety of.

DETAILED DESCRIPTION OF THE INVENTION

Figure 1:
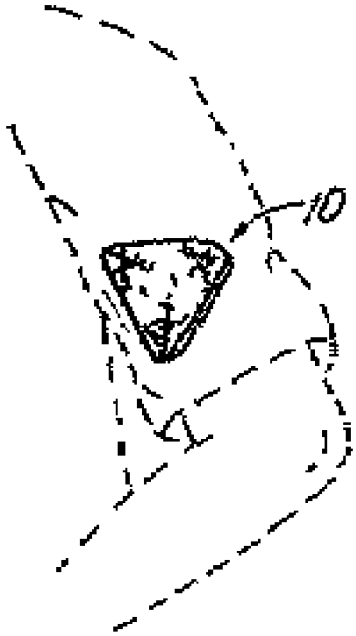
FIG. 1 is a view showing an entirely disposable device with one or more sneeze/cough pads worn on a sleeve of a shirt.

Referring now to the drawings wherein like reference numerals designate identical or corresponding parts throughout the several views, FIG. 1 shows a device 10 that can include one or more sneeze/cough pads 13 constructed in accordance with a preferred embodiment of the present invention attached to the sleeve of a person shown in dashed lines.

Figure 2:
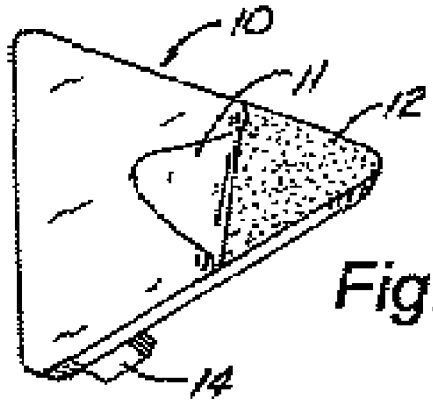
FIG. 2 shows the back side of a sneeze/cough pad shaped to cover a user's nose and mouth area and showing how a layer is peeled off of the back to allow an adhesive surface to be exposed so the device can be attached to the sleeve of a garment or to a bare arm.
Figure 3:
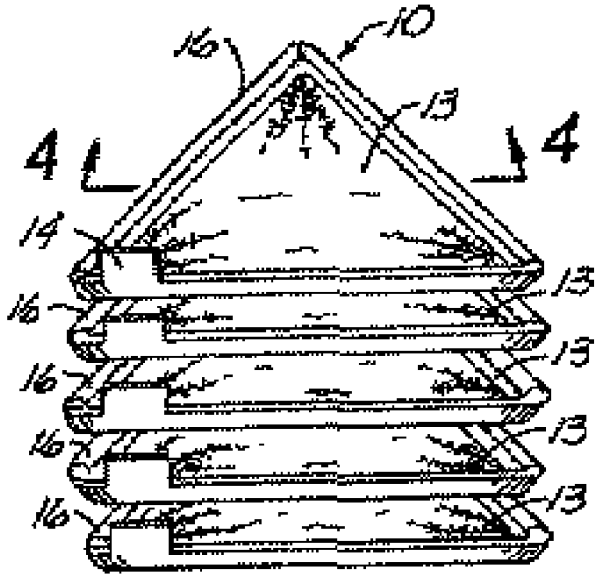
FIG. 3 is an exploded perspective view of the device to show how several pads nest together and are removable one at a time.
Figure 4:
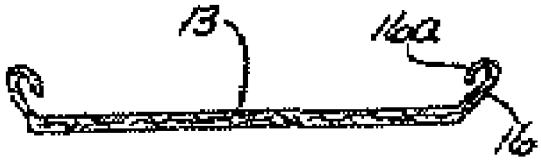
FIG. 4 is a cross-sectional view of one of the contoured sneeze/cough pads of the device taken along line 4-4 of FIG. 3.

The device 10 is shown in more detail in FIGS. 2-4. FIG. 2 shows device 10 that includes a single pad. FIG. 4 shows the device 10 with multiple pads 13 that are stackable. The back (i.e. bottom) of each pad 13 has an adhesive layer 12 which is exposed when layer 11 is peeled off of it as shown in FIG. 2. That allows the pad 13 to stick to the sleeve of a person or to an arm or hand of such person. Each pad 13 of the device 10 can be an entirely disposable unit that adheres to the user with the adhesive surface 12.

Each pad 13 of the device 10 includes a clean and dry absorbent cloth or the like (i.e. absorbent layer) and can optionally have a bacterial wipe on the back side of for wiping a user's hands and mouth before throwing the pad 13 away. Also, optionally, each pad 13 of the device 10 would have the back with an adhesive surface 12 thereon, which back is constructed of an impermeable material such as vinyl or some other flexible plastic material to prevent the germs of a top pad 13 of the device 10 from passing to a lower pad 13. Of course non-plastic impermeable materials could be used instead of plastic ones. So it will be appreciated that each pad 13 of the device 10 would preferably have the clean and dry absorbent layer attached to the impermeable material with adhesive 12 on the back of it. Only the extreme bottom pad 13 of the device 10 shown in FIG. 1 would have the layer 11 thereon.

Figure 10:
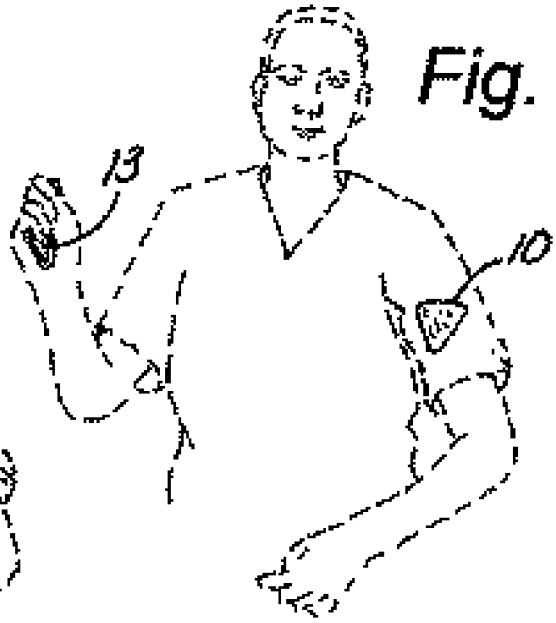
FIG. 10 shows the nurse of FIGS. 5-8 holding the removed top pad into which the nurse had sneezed or coughed.
Figure 11:
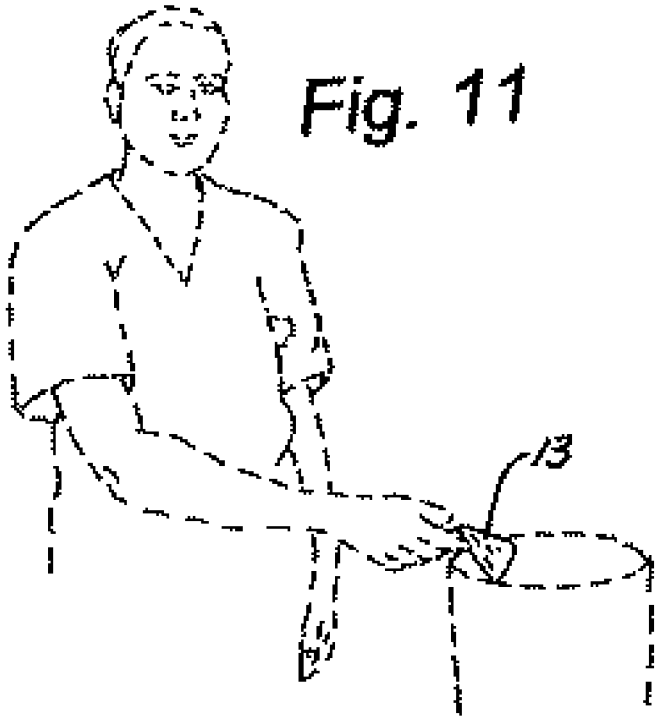
FIG. 11 shows the nurse of FIGS. 5-8 throwing away the removed top pad into which the nurse had sneezed or coughed.
Figure 12:
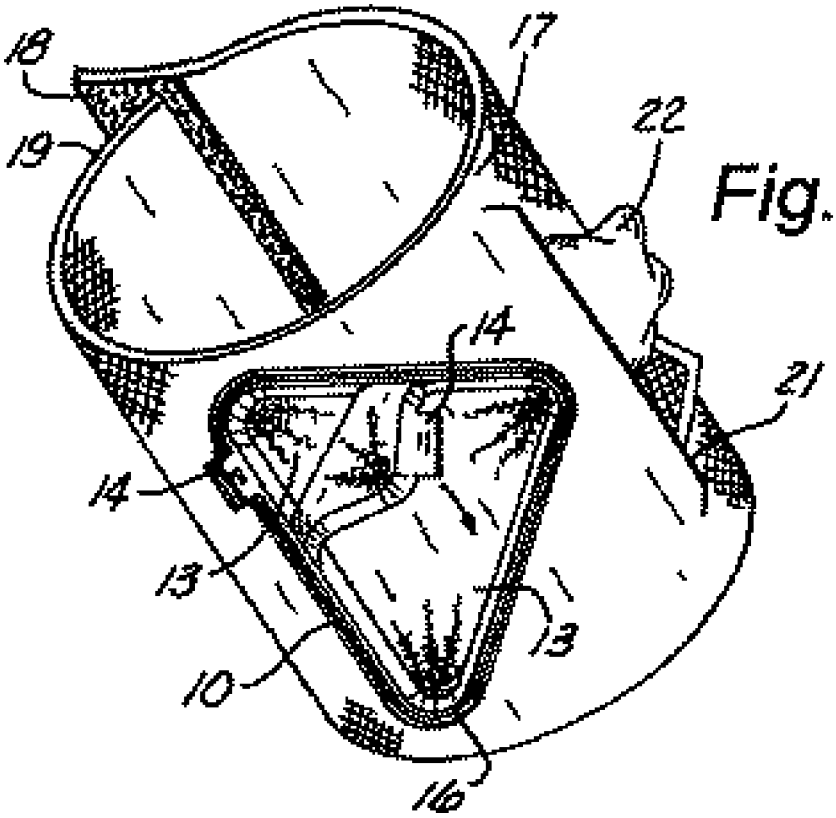
FIG. 12 shows an alternate embodiment with a VELCRO secured arm band to which the device with multiple pads is and a tissue/bacterial wipe and vinyl glove extending from a pocket in the armband.
Figure 13:
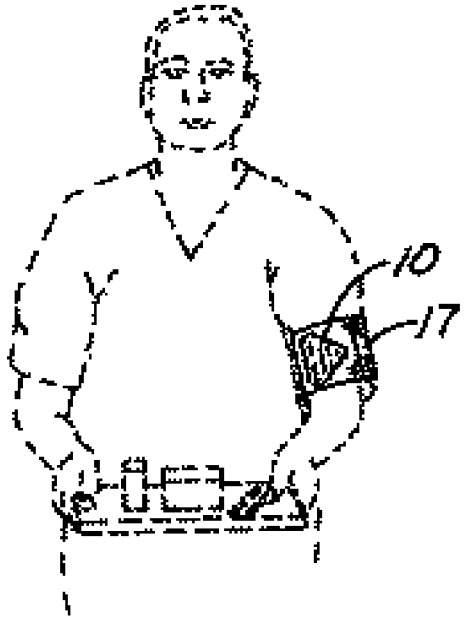
FIG. 13 shows a nurse in a hospital carrying a tray of food while using the arm band with the device of FIG. 12.

The device 10 can also be attached to an arm band 17 like that is shown in FIG. 12, which can be washable, adjustable and closed via straps, hook and loop fasteners 18 and 19, ties, or adhesive. Various attaching means can be utilized without departing from the scope of the invention and would be familiar to those skilled in the art. The device 10 could be worn anywhere along the shoulder, arm or hand, wherever the user finds it most comfortable. Because device 10 can be worn on the arm, it is always readily available and can even be used when both hands are occupied as shown in FIGS. 5-11, 13 and 14. Each pad 13 of device 10 is preferably shaped to conform to the general outline of a user's nose and mouth region thus helping to better block the escape of germs and requiring less material for manufacture, or it can be three-dimensionally contoured as shown in FIGS. 3 and 4. The device 10 preferably has a raised welt and/or a baffle 16 (i.e. peripheral wall) around the outer periphery of each pad 13 of the device 10 of the side to be sneezed/coughed into, to prevent cough/sneeze byproducts (mucous, germs, saliva) from being expelled out from the edges of the pad 10. The raised welt and/or baffle 16 (peripheral wall) preferably also has a downwardly and inwardly extending top 16*a* as shown in FIG. 4. Ideally the welt and/or baffle 16 (peripheral wall) and top 16*a* extend completely around the periphery of each pad 13 of the device 10.

Within this arm band 17, constructed of a washable material, such as but not limited to, vinyl or plastic, resides a pocket or pockets 21. These pockets 21 could have a cover over their openings, secured by another hook and loop fastener (not shown) or other type of closure. The user can store objects 22 such as surgical type face masks, gloves of latex or similar materials, and antibacterial wipes within these pockets 21 for ready access. The wipes can be used to disinfect stethoscopes, hands and other objects, which spread germs in a health care or food service environment.

Figure 9:
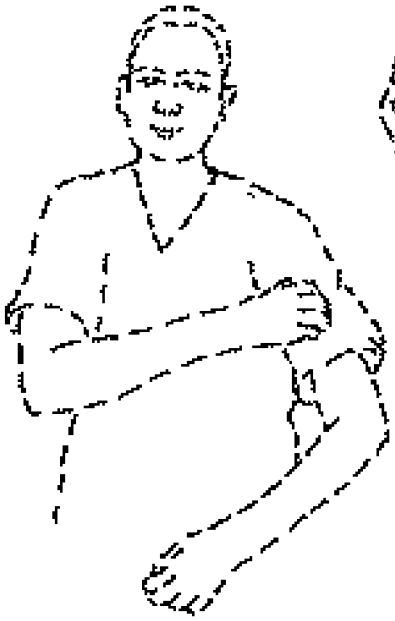
FIG. 9 shows the nurse of FIGS. 5-8 removing a top pad of the device of FIG. 1 into which the nurse had sneezed or coughed, exposing a fresh pad of the device beneath.

The arm band 17 could optionally be made in various colors/materials to match uniforms and could be imprinted with a business or institutions' name or logo etc. After each use, i.e. after being sneezed or coughed into as shown in FIG. 6, the user would peel off or otherwise remove and dispose of the used pad 13 of the device 10 as shown in FIGS. 9 and 10, which would reveal a fresh pad 13 of the device beneath it as illustrated in FIG. 3. The device 10, in a preferred embodiment, could contain from one to six pads 13, but more pads 13 could be used without departing from the scope of the invention. Each of the pads 13 could optionally be made to make usage evident by means of a pressure or moisture activated color change of the absorbent layer of the pads 13. Although, for most uses, the pads 13 do not have to be sterile, optionally, each pad 13 could include a removable cover (not shown) so that if a user has time, the user could remove the cover, if not, the user could cough/sneeze directly into the cover.

Figure 14:
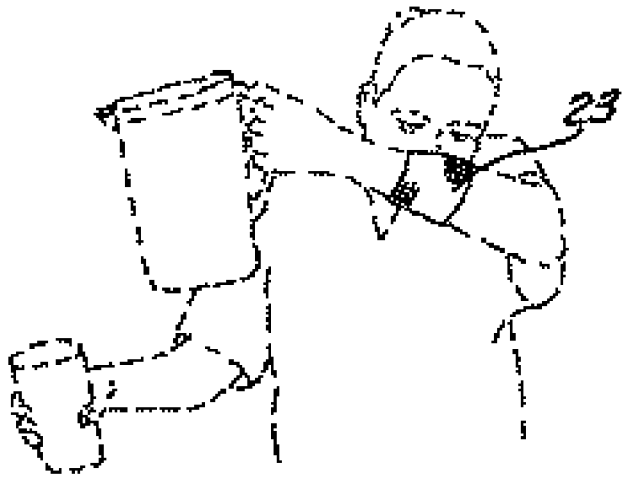
FIG. 14 shows the nurse of FIG. 13 coughing or sneezing into the device attached to the arm band of FIG. 12 being worn on the forearm.
Figure 15:
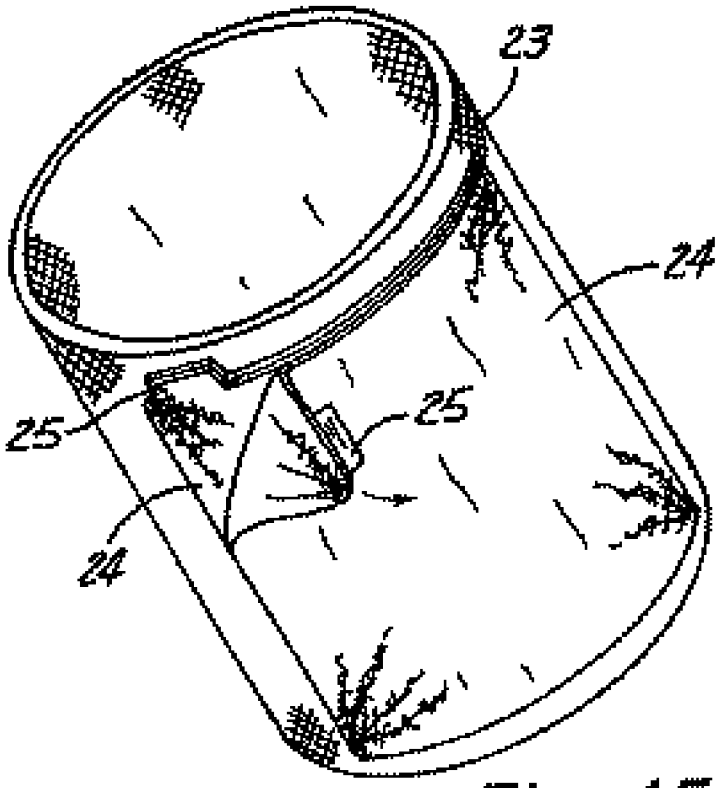

FIGS. 14 and 15 show an alternate embodiment of the invention using an elastic arm band 23 having a device that includes multiple rectangular pads 24 that can be peeled off, one by one by pulling on tabs 25. Ideally this embodiment will also use a raised peripheral wall (not shown).

In operation, FIG. 5 shows a nurse carrying a tray of food. When the nurse has to cough or sneeze, it is done into a pad 13 of device 10 as shown in FIG. 6. Also, if the nurse has a glass of liquid, such as water in one hand and a pitcher of liquid, such a water, in the other hand as shown in FIG. 7, the nurse can sneeze or cough into a pad 13 of device 10 as shown in FIG. 8, preferably by putting his or her nose and mouth firmly against a pad 13 of the device 10 to catch air, germs, mucus or the like. After the sneeze or cough, the nurse can peel off the top pad 13 from device 10 as shown in FIGS. 9 and 10 and throw the used top pad 13 away as shown in FIG. 11. FIG. 14 shows the nurse coughing or sneezing into a rectangular pad 24 attached to arm band 23, shown being worn on the forearm of the nurse.

Accordingly, it will be appreciated that the preferred embodiments do indeed overcome the deficiencies of the prior art. Obviously many modifications and variations of the present invention are possible in light of the above teachings. It is therefore to be understood that, within the scope of the appended claims, the invention may be practiced otherwise than as specifically described.

The invention claimed is:

1. An apparatus to reduce the effect of coughing or sneezing, the apparatus comprising:

a pad having a configuration that conforms to a general outline of a person's nose and mouth region, said pad comprising:

a bottom having a first side and an opposing second side;

an absorbent material disposed on said first side of said bottom to receive byproducts of a cough or a sneeze;

a peripheral wall extending from said bottom substantially upward entirely above said absorbent material and around the entire periphery of said bottom, said peripheral wall configured to prevent escape of said byproducts from said pad; and a means for operatively attaching said pad to said person's body or garment.

2. The apparatus of claim 1, wherein said configuration of said pad is one selected from the group consisting of: a triangular configuration and a rectangular configuration.

3. The apparatus of claim 1, wherein said bottom is made of an impermeable material.

4. The apparatus of claim 1, wherein said peripheral wall includes a top that curves inwardly and downwardly toward the interior of said pad.

5. The apparatus of claim 1, wherein said means for operatively attaching said pad includes an adhesive disposed on said second side of said bottom.

6. The apparatus of claim 5, wherein said apparatus further comprises an armband to which said pad is adhered by said adhesive.

7. The apparatus of claim 1, further comprising a removable cover disposed atop said pad.

8. The apparatus of claim 1, further comprising a removable backing disposed on said second side.

9. The apparatus of claim 1, wherein said peripheral wall includes a tab projecting substantially upward from said peripheral wall.

10. The apparatus of claim 1, further comprising a bacterial wipe disposed on said second side of said bottom.

11. An apparatus to reduce the effect of coughing or sneezing, the apparatus comprising:

a plurality of stackable pads having a configuration that conforms to a general outline of a person's nose and mouth region, each stackable pad comprising:

a bottom having a first side and an opposing second side;

an absorbent material disposed on said first side of said bottom to receive byproducts of a cough or a sneeze;

a peripheral wall extending from said bottom substantially upward entirely above said absorbent material and around the entire periphery of said bottom, said peripheral wall configured to prevent escape of said byproducts from said pad; and means for operatively attaching each stackable pad at least to another stackable pad, said person's body or garment.

12. The apparatus of claim 11, wherein said means for operatively attaching each stackable pad includes an adhesive disposed on said second side of said bottom.

13. The apparatus of claim 12, wherein said apparatus further comprises an armband to which a bottommost pad of said plurality of pads is attached by said adhesive disposed on said second side of said bottom.

14. The apparatus of claim 11, wherein said peripheral wall includes a tab projecting substantially upward from said peripheral wall to facilitate removal of each stackable pad from at least another stackable pad.

15. A method of reducing the effect of coughing or sneezing, the method comprising:

operatively attaching a pad to a person's body or garment, said pad having a configuration that conforms to a general outline of said person's nose and mouth region, said pad comprising a bottom having a first side and an opposing second side, an absorbent material disposed on said first side of said bottom, and a peripheral wall extending from said bottom substantially upward entirely above said absorbent material and around the entire periphery of said bottom; and receiving byproducts of a cough or a sneeze into said pad.

16. The method of claim 15, further comprising receiving said person's nose and mouth region adjacent said pad and in conformity with said configuration of said pad.

17. The method of claim 15, further comprising:

removing said pad from said person's body or garment after receiving said byproducts of said cough or said sneeze into said pad; and discarding said pad.

18. A method of reducing the effect of coughing or sneezing, the method comprising:

operatively attaching a stackable pad apparatus to a person's body or garment, said stackable pad apparatus including a plurality of stackable pads, each stackable pad having a configuration that conforms to a general outline of a person's nose and mouth region, each said stackable pad comprising a bottom having a first side and an opposing second side, an absorbent material disposed on said first side of said bottom, and a peripheral wall extending from said bottom substantially upward entirely above said absorbent material and around the entire periphery of said bottom; and receiving byproducts of a cough or a sneeze into a stackable pad of said stackable pad apparatus.

19. The method of claim 18, further comprising receiving said person's nose and mouth region adjacent a topmost stackable pad of said stackable pad apparatus and in conformity with said configuration of said topmost stackable pad.

20. The method of claim 19, further comprising removing said topmost stackable pad from said stackable pad apparatus to expose a lower stackable pad of said stackable pad apparatus.

21. The method of claim 20, using a bacterial wipe disposed on said second side of said bottom of said removed topmost stackable pad to wipe the person's nose and mouth region.

22. The method of claim 20, further comprising discarding said removed topmost stackable pad.

* * * * *